US005195591A

United States Patent [19]

Blount et al.

[11] Patent Number: 5,195,591

[45] Date of Patent: Mar. 23, 1993

[54] PERMANENT WHIPSTOCK AND PLACEMENT METHOD

[75] Inventors: Curtis G. Blount, Wasilla; David D. Hearn, Anchorage, both of Ak.

[73] Assignee: Atlantic Richfield Company, Los Angeles, Calif.

[21] Appl. No.: 752,705

[22] Filed: Aug. 30, 1991

[51] Int. Cl.[5] ..... E21B 33/128

[52] U.S. Cl. ..... 166/380; 166/117.5

[58] Field of Search ..... 166/117.5, 117.6, 380; 175/81

[56] References Cited

U.S. PATENT DOCUMENTS

| | | | |
|---|---|---|---|
| 1,804,819 | 5/1931 | Spencer et al. . | |
| 1,812,880 | 7/1931 | Kinzbach et al. . | |
| 2,324,682 | 7/1943 | De Long | 255/1.4 |
| 2,401,893 | 6/1946 | Williams, Jr. | 166/117.6 X |
| 2,445,100 | 7/1948 | Wright | 255/1.6 |
| 2,699,920 | 1/1955 | Zublin | 175/81 |
| 3,115,935 | 12/1963 | Hooton | 166/117.6 |
| 3,339,636 | 9/1967 | Frisby | 166/117.5 |
| 4,007,797 | 2/1977 | Jeter | 175/26 |
| 4,153,109 | 5/1979 | Szescila | 166/250 |
| 4,285,399 | 8/1981 | Holland et al. | 166/117.6 X |
| 4,397,355 | 8/1983 | McLamore | 166/117.6 X |
| 4,765,404 | 8/1988 | Bailey et al. | 166/117.6 |

*Primary Examiner*—William P. Neuder
*Attorney, Agent, or Firm*—Michael E. Martin

[57] ABSTRACT

Coring and other operations may be carried out through a cased wellbore by placing a permanent whipstock having a tool guide surface thereon in the wellbore through the production tubing string and anchoring the whipstock with cement after positioning the whipstock in a predetermined orientation of the guide surface. An underreamer faces off the cement and cuts a pilot bore for guiding a casing cutting tool so that the whipstock guide surface is properly engaged during the casing wall milling and core drilling operations. The whipstock is inserted into the wellbore through a production tubing includes a hydraulic actuator for moving the whipstock laterally after exiting the lower end of the tubing string to assist in supporting the whipstock in the wellbore and to properly orient the guide surface. The actuator is supplied with pressure fluid through a coilable tubing string connected to the whipstock during the insertion and placement process.

17 Claims, 3 Drawing Sheets

PERMANENT WHIPSTOCK AND PLACEMENT METHOD

BACKGROUND OF THE INVENTION

1. Field of the Invention

The present invention pertains to a permanent whipstock and placement method in a cased well for use in guiding a casing milling tool and the like.

2. Background

Producing oil and gas from subterranean formations through wellbores sometimes requires inspection of formation conditions to analyze production characteristics and prescribe future production techniques. Analysis of formation characteristics or changes is often dependent on the ability to take suitable core samples of the formation in the vicinity of the wellbore. Conventional coring operations require that the well be shut in while a drilling rig is brought in and operated to perform the coring operation. This process is time consuming and expensive and usually requires shut-in of the well and other procedures to reduce or eliminate fluid pressures at the surface during all phases of the drilling and core sample acquisition process.

Moreover, limitations on minimum core diameter and the inability to provide and set a suitable whipstock so that the casing can be milled out to gain access to the formation have, heretofore, precluded obtaining core samples through small diameter tubing strings and other wellbore structures of a diameter less than conventional casing diameters.

An improved method for minimizing the invasion of fluids into a core is described in a U.S. patent application Ser. No. 07/752,308 entitled: Method for Obtaining Cores From a Producing Well by Eric W. Skaalure, and a unique method for obtaining cores is described in a U.S. patent application Ser. No. 07/752,704 entitled: Coring With Tubing Run Tools From a Producing Well by Curtis G. Blount, et al., both assigned to the assignee of the present invention and both of even filing date with this application. The present invention provides a unique whipstock and placement method which is particularly advantageous for use in conjunction with operations for obtaining core samples from and through a well.

SUMMARY OF THE INVENTION

The present invention provides an improved method of drilling into a formation region of interest from a well utilizing an improved whipstock and whipstock placement technique for determining the orientation of the casing milling and drilling operations. In accordance with an important aspect of the invention, a whipstock is provided which may be run into a well through a production tubing string or the like and set in a desired orientation in the casing bore to engage a milling tool for deflection of the milling tool into a desired direction to cut through the casing into the formation. The whipstock is preferably permanently encased in cement and the cement is drilled out to provide a pilot hole for guiding the milling tool upon insertion of the milling tool through the production tubing and attached to a coilable tubing string.

In accordance with another aspect of the present invention, a permanent whipstock is disposed in a cased wellbore attached to a suitable anchoring device, such as an inflatable packer, which is inserted into the wellbore through a production tubing string. The whipstock is of a unique configuration which is such as to provide for positioning of the whipstock after it exits from the lower end of a tubing string to provide proper orientation and guidance of the milling and drilling tools.

Still further in accordance with the present invention, there is provided an improved whipstock which is adapted particularly for insertion into a well casing through a tubing string which is smaller in diameter than the casing itself. The whipstock includes means for orienting the tool guide surface after the whipstock exits the lower end of the tubing string and is at its prescribed depth in the wellbore. The whipstock is of unique configuration to facilitate its insertion into the casing through a smaller diameter tubing string while being disposable into a position which will provide for guidance of a milling tool which can be generally centered in the wellbore as it engages the whipstock.

Those skilled in the art will recognize the above-described features and advantages of the present invention together with other superior aspects thereof upon reading the detailed description which follows in conjunction with the drawing.

DESCRIPTION OF THE PREFERRED EMBODIMENTS

Figures 1A, 1B:
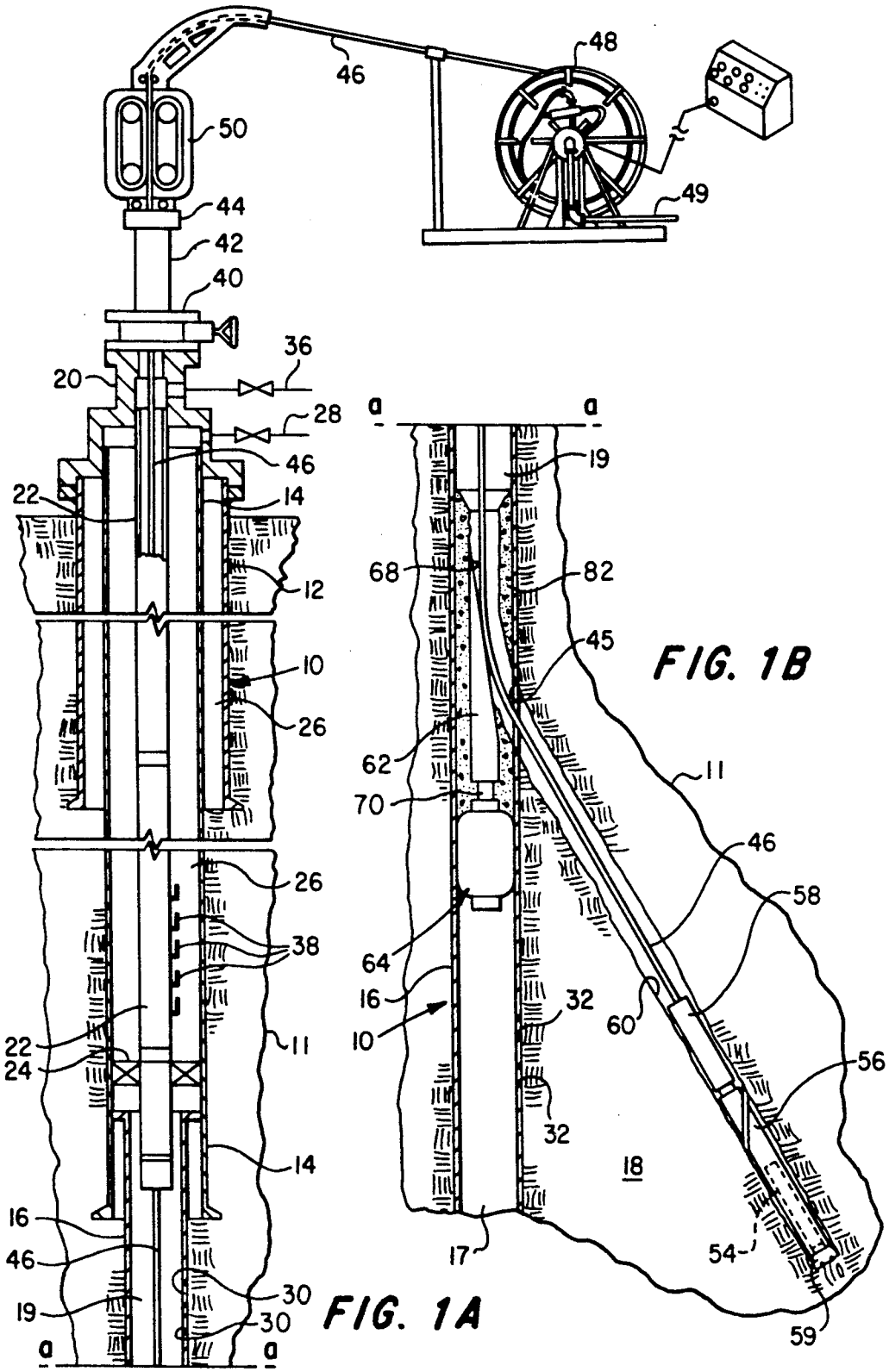
FIG. 1A is a vertical section view, in somewhat schematic form, of a well and showing a coilable tubing inserted through the production tubing string.
FIG. 1B is a continuation of FIG. 1 from the line a—a showing a whipstock in accordance with the invention guiding a coring tool.

In the description which follows, like parts are marked throughout the specification and drawing with the same reference numerals, respectively. The drawing figures are not necessarily to scale and certain features are shown in schematic form or are exaggerated in scale in the interest of clarity and conciseness.

Referring to FIGS. 1A and 1B, there is illustrated in somewhat schematic form an oil production well, generally designated by the number 10, extending into an earth formation 11. The well 10 includes a conventional surface casing 12, an intermediate casing string 14 and a production liner or casing 16 extending into an oil-producing zone 18 of formation 11. A conventional wellhead 20 is connected to the casing strings 12 and 14 and is also suitably connected to a production fluid tubing string 22 extending within the casing 14 and partially within the casing 16. A suitable seal 24 is formed in the wellbore between the tubing string 22 and casing 14 by a packer or the like and which delimits an annulus 26 between the casing 14 and the tubing string. The well 10 is adapted to produce fluids from the zone of interest 18 through suitable perforations 30 and/or 32 formed in the production casing 16 at desired intervals. Produced fluids can be assisted in their path to the surface, for transport through a production flow line 36, by gas which is injected into the space 26 and enters the production tubing string 22 through suitable gas lift valves indicated at 38. The aforedescribed well structure is substantially conventional, known to those skilled in the art and is exemplary of a well which may be produced through natural formation pressures with or without the assistance of gas injection to reduce the pressure in the interior spaces 17, 19 of the casing 16.

The wellhead 20 is provided with a conventional crown valve 40 and a lubricator 42 mounted on the wellhead above the crown valve. The lubricator 42 includes a stuffing box 44 through which may be inserted or withdrawn a coilable metal tubing string 46 which, in FIGS. 1A and 1B is shown extending through the tubing string 22 into the casing 16 and diverted through a window 45 in the casing (FIG. 1B) as will be explained in further detail herein. The tubing string 46 is adapted to be inserted into and withdrawn from the well 10 by way of a conventional tubing injection unit 50 and the tubing string 46 may be coiled onto a storage reel 48 of a type described in further detail in U.S. Pat. No. 4,685,516 to Smith et al, and assigned to the assignee of the present invention. The lubricator 42 is of a conventional configuration which permits the connection of certain tools to the distal end of the tubing string 46 for insertion into and withdrawal from the wellbore space 19 by way of the production tubing string 22.

The present invention is advantageously used in conjunction with a method for obtaining a core sample of the formation 18, which core sample is indicated by the numeral 54 in FIG. 1B. The core sample 54 is shown inserted in a core barrel 56 connected to a pressure-fluid-driven motor 58 which is connected to the distal end of the tubing string 46 as indicated. The core sample 54 is being extracted from the formation 18 without interrupting production from the well 10. In fact, the window 45 which has been cut into the formation 18 also provides an entry port into the interior space 19 of the casing 16 to allow formation fluids to enter the casing and to be produced up through the tubing string 22 in the same manner that fluids enter the tubing string from the perforations or ports 30 and/or 32. The motor 58 and the core barrel 56 may be of substantially conventional construction, only being of a diameter small enough to be inserted into the space 19 through the tubing string 22. The motor 58 is driven by pressure fluid to rotate the core barrel 56 to cut a core 54 using a core barrel cutting bit 59, which pressure fluid, such as water or diesel fuel, is supplied from a source, not shown, by way of conduit 49 and is pumped down through the tubing 46 for providing power to drive the motor 58 and for serving as a cuttings evacuation fluid while forming the bore 60 in the formation 18. As shown in FIG. 1B the tubing string 46 has been diverted into the direction illustrated by a unique whipstock 62 which is positioned within the space 17 in accordance with a method which will be described in further detail herein.

As previously mentioned, in order to provide the core 54 the diameter of the whipstock 62, core barrel 56 and the motor 58 must be less than the inside diameter of the tubing string 22. By way of example, it is not uncommon to have production tubing strings in wells in the Prudhoe Bay Oil Field, Ak., which have an inside diameter of about 3.75 inches. This space limitation dictates that the diameter of the core 54 may be required to be as small as 2.4 inches or even less. Such small diameter cores, when obtained with conventional coring techniques will suffer invasion all the way to the center of the core from the so-called coring fluid, that is the fluid being used to drive the motor 58 to rotate the core barrel 56. Such an invasion will damage the core to the extent that it cannot be properly analyzed.

The aforementioned advantages of using the tubing 46 and the tubing injection unit 50 in place of a conventional drilling rig for obtaining the core 54 are enhanced by the relatively short times required to trip in and out of the wellbore including the bore 60 in the process of core acquisition and retrieval. This process alone also reduces the exposure of the core to unwanted fluids and decreases core contamination by diffusion of the coring fluid into the core sample itself. The relatively short acquisition time provided by the injection and retrieval of the core barrel 56 utilizing the tubing 46 improves the possibility of virtually no invasion of the coring fluid toward the core center.

Production of wellbore fluids through the tubing string 22 may also be carried out during core acquisition. If the formation is producing fluids through the perforations 30 as well as the window 45, or plural windows if plural cores are taken from different directions within the formation 18, this production is not interrupted by the core acquisition process. In fact, the advantage of continued production also works synergistically with core acquisition in that the cuttings generated during cutting the window 45 and the bore 60 are more effectively removed from the wellbore with assistance from production fluid since the coring fluid alone may not be circulated at a sufficient rate to remove all the cuttings as compared with coring fluid circulation rates utilized in conventional coring with a rotary type drilling rig.

Referring to FIG. 1B, as well as FIGS. 2 through 5, the whipstock 62 is set in place to provide for cutting the window 45 and giving direction to the eventual formation of the bore 60. Prior to cutting the window 45 an inflatable packer 64 is conveyed into the wellbore and set in the position shown within the casing 16 by traversing the packer through the tubing string 22 on the distal end of the tubing 46. The packer 64 may have an inflatable bladder and setting mechanism similar to the packer described in U.S. Pat. No. 4,787,446 to Howell et al and assigned to the assignee of the present invention. Moreover, the tubing string 46 may be released from the packer 64, once it is set in the position shown, utilizing a coupling of the type described in U.S. Pat. No. 4,913,229 to D. D. Hearn and also assigned to the assignee of the present invention.

The whipstock 62 includes a guide surface 68 formed thereon. The whipstock 62 also includes a shank portion 70 which is insertable within a mandrel 72 forming part of the packer 64. The orientation of the whipstock 62 can be carried out utilizing conventional orientation methods. For example, the mandrel 72 may be provided with a suitable keyway 77, FIG. 5, formed therein. Upon setting the packer 64 in the casing 16, a survey instrument would be lowered into the wellbore to determine the orientation of the keyway 77 with respect to a reference point and the longitudinal central axis 79. The whipstock shank 70 could then be formed to have a key portion 80, FIG. 5, positioned with respect to the guide surface 68 such that upon insertion of the whipstock 62 into the mandrel 72, the key 80 would engage the keyway 77 to orient the surface 68 in the preferred direction with respect to the axis 79.

Figure 2:
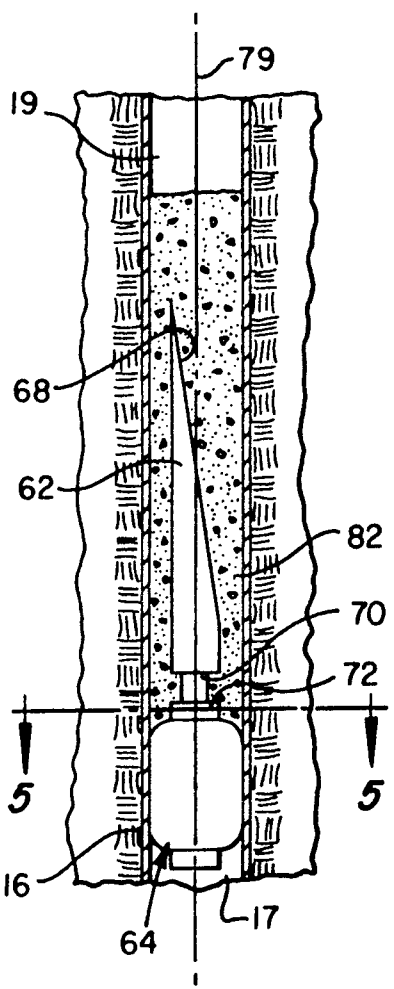
FIG. 2 is a section view showing the installation of the whipstock just after placement of cement around the whipstock.
Figure 3:
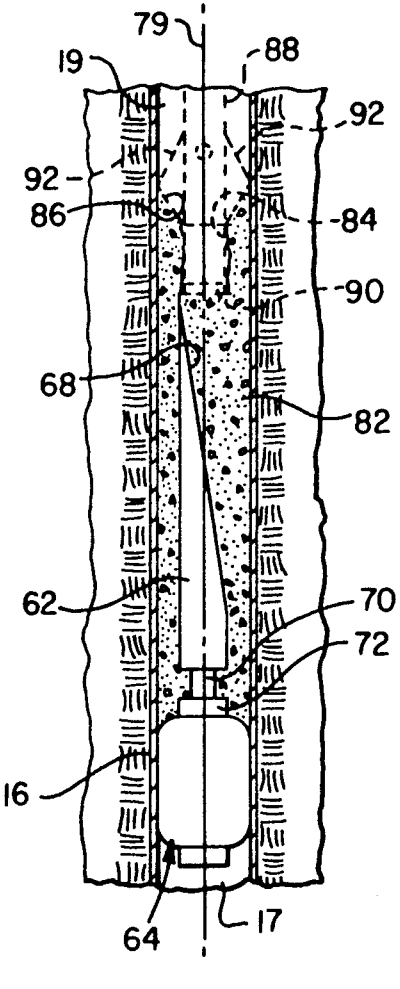
FIG. 3 is a view similar to FIG. 2 showing the operation of reaming out the cement to provide a pilot bore for the casing milling tool.

Upon setting the whipstock 62 in position as shown in FIG. 2 a quantity of a stabilizing or anchoring material such as cement 82 is injected into the casing by conventional methods, or as described in U.S. Pat. No. 4,627,496 to Ashford et al, or including pumping cement through the tubing 46 to encase the whipstock 62 as shown. Once the cement 82 has hardened, a pilot bore 84 may be formed in the cement as indicated in FIG. 3, said bore including a funnel-shaped entry portion 86. The bore 84 and the funnel-shaped entry portion 86 may be formed using a cutting tool 88 having a pilot bit portion 90 and retractable cutting blades 92 formed thereon. The cutting tool 88 may be of a type disclosed in U.S. Pat. No. 4,809,793 to C. D. Hailey which describes a tool which may be conveyed on the end of a tubing string, such as the tubing string 46, and rotatably driven by a downhole motor similar to the motor 58 to form the pilot bore 84 and the entry portion 86. The pilot bore portion 84 is preferably formed substantially coaxial with the central axis 79.

Figure 4:
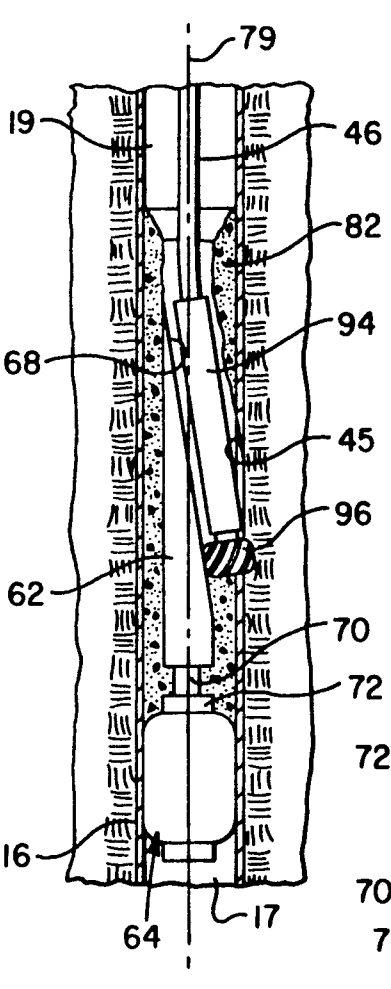
FIG. 4 is a view similar to FIG. 3 showing the coiled tubing conveyed milling tool milling a window in the well casing.
Figure 5:
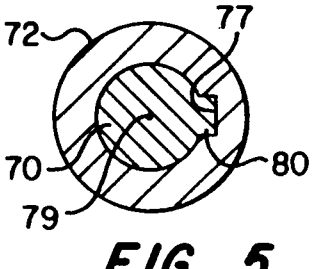
FIG. 5 is a section view taken along the line 5—5 of FIG. 2.

Upon formation of the pilot bore 84, the tool 88 is withdrawn from the wellbore through the tubing string 22 and replaced by a milling motor 94 having a rotary milling tool 96 connected thereto. The motor 94 and milling tool 96 are lowered into the wellbore through the tubing string 22, centered in the wellbore by engagement with the cement plug 82 through the pilot bore 84 and then pressure fluid is supplied to the motor 94 to commence milling out a portion of the cement plug and the sidewall of the casing 16 to form the window 45, as shown in FIG. 4.

The milling operation is continued until the milling tool 96 has formed the window 45 whereupon the tubing string 46 is again withdrawn through the tubing string 22 until the motor 94 and cutter 96 are in the lubricator 42. The motor 94 may then be disconnected from the tubing string 46 and replaced by the motor 58 and the core barrel 56. The motor 58 and core barrel 56 are then tripped into the well through the tubing string 22 and core drilling is commenced to form the bore 60 and to obtain one or more cores 54.

During the operation to acquire one or more cores 54, gas can be injected into the space 26 and through the gas lift valves 38 into the production tubing string 22 to convey fluids through the tubing string 22 and to the conduit 36 through the wellhead 20 and to reduce the pressure in the bore 60 and the wellbore space 19 to a value below the nominal pressure in the formation 18. Accordingly, formation fluids are produced into the wellbore and coring fluid will not flow into the formation from the wellbore. Coring fluids will also not enter the core 54 since pressure in the core will be greater than in the bore 60 and the wellbore space 19. Accordingly, continued production of fluids from the well by, for example, utilizing gas injection to lift fluid through the tubing string 22, will provide a core 54 with relatively low invasion of fluids into the core proper and essentially no fluid invasion to the core center. The well 10 may, of course, be allowed to continue production after withdrawal of the core barrel 56 with the tubing 46. After one or more cores are obtained the new perforations or windows, such as the window 45, may continue to serve as perforations for allowing production of fluids from the formation 18 or the window 45 may be suitably sealed off with conventional equipment.

Figure 6:
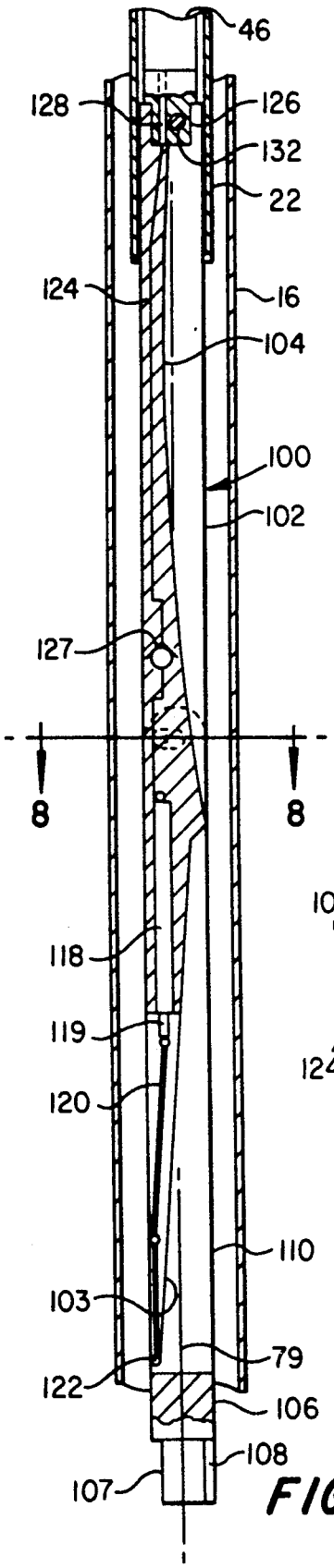
FIG. 6 is a vertical section view showing an alternate embodiment of the improved whipstock of the present invention being inserted into the wellbore.
Figure 8:
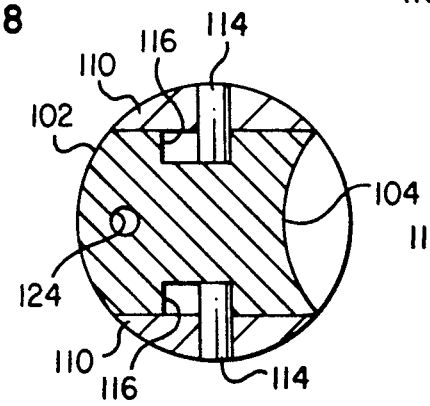
FIG. 8 is a section view taken along line 8—8 of FIG. 6.
Figure 7:
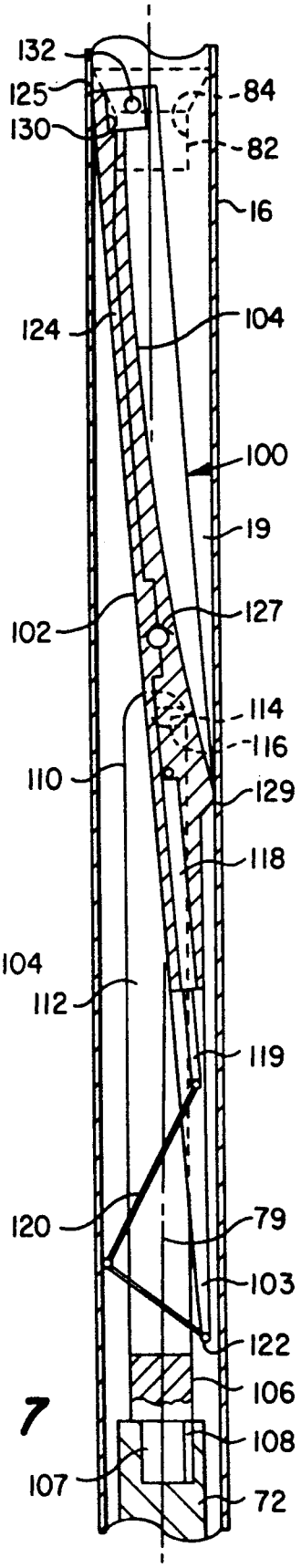
FIG. 7 is a view similar to FIG. 6 showing the whipstock in its final deployed position.

Referring now to FIGS. 6 through 8, an alternate embodiment of a whipstock in accordance with the present invention is illustrated and generally designated by the numeral 100. The whipstock 100 includes a part formed by an elongated, generally cylindrical body member 102 having a diameter such that it may be traversed through the tubing string 22. The body member 102 includes a guide surface 104 formed thereon and operable to be appropriately configured, when the whipstock 100 is deployed into its working position illustrated in FIG. 7, to guide the milling tool, core drill and tubing as described above. The whipstock 100 also includes a stab member 106 having a reduced diameter pilot part 107 including a key portion 108 adapted to fit into the socket of the mandrel 72 so that the key portion 108 is aligned with and fitted in the keyway 77 to orient the whipstock with respect to the axis 79. The stab member 106 includes opposed upwardly-extending tines 110 forming a slot 112 therebetween. The lower end 103 of the whipstock body member 102 is disposed between the tines 110, and the body member is pivotally and slidably connected to the tines by opposed trunnions 114 which are fitted into elongated transversely extending slots 116 in the body member 102.

A hydraulic cylinder-type actuator 118 is disposed on the body member 102 and is connected to an articulated linkage 120 which is anchored at its lower end 122 to the lower end 103 of the body member 102. The linkage 120 is responsive to actuation of the piston rod 119 of the actuator 118 to engage the wall of the casing 16 and pivot the whipstock 100 generally about the axes of the trunnions 114 while also sliding the body member 102 somewhat laterally with respect to the axis 79 to properly position the guide surface 104. By providing the body member 102 to be adapted for lateral movement in the wellbore, the upper end of the body member 102 may retain sufficient strength, through material thickness, to prevent failure when well tools engage the guide surface 104. Moreover, the body member 102 is also operable to be adequately supported by the casing 16 at contact points 127 and 129, as shown in FIG. 7, to provide a more rigid support for guiding the aforementioned tools and tubing string and to minimize loads on the packer 64.

The actuator 118 is operable to receive pressure fluid through a conduit 124 having a check valve 127 interposed therein. The upper end of the conduit 124 is operable to be in communication with a spigot member 126 which may be suitably connected to the lower end of the coilable tubing 46 and having a passage 128 formed therein adapted to be in communication with the conduit 124. The spigot 126 is operable to fit in a receptacle 130 formed in the upper end of the body member 102 and secured therein by a shear pin or key member 132.

The whipstock 100 is thus adapted to be connected to the lower end of a tubing string such as the tubing 46 and lowered through the tubing string 22 until the whipstock exits the distal end of the tubing string 22 and is properly oriented and engaged with the mandrel 72 of the packer 64. In this way, the orientation of the guide surface 104 may be obtained in the desired direction in the same manner as the orientation of the guide surface 68 is obtained for the whipstock 62. Following this step, pressure fluid may be pumped down through the tubing 46 and the conduit 124 to effect operation of the actuator 118 to articulate the linkage 120 to engage the casing 16 and kick the whipstock 102 from the position shown in FIG. 6 into the position shown in FIG. 7 so that the guide surface 104 is properly oriented to engage a milling tool such as the tool 96 and the tubing string 46 during casing milling, formation drilling and core acquisition operations. The tubing 46 may then be released from the upper end of the whipstock 100 by rotation or longitudinal extension of the tubing to shear the connection formed between the spigot 126 and the member 102 at the pin 132. The check valve 127 prevents release of pressure fluid from the actuator 118 so that it maintains the linkage 120 in the position shown in FIG. 7. As indicated in FIG. 7, the whipstock 100 may then be encased in cement 82 and the pilot bore 84 formed and aligned with the guide surface 104.

Thanks to the method and apparatus described herein, core samples may be obtained from production wells using coilable tubing or other relatively small diameter tubing strings insertable through the well production tubing without shutting the well in and without requiring the use of conventional drilling rigs. Higher quality cores may be obtained by eliminating conventional weighted drilling fluids and by reducing the wellbore pressure during the core acquisition process. The equipment described herein, such as the tubing injection apparatus 50, the lubricator 42, the wellhead 20, the gas lift injection valves 38, the seal 24, the motors 58 and 94, the core barrel 56 and the packer 64, is available from commercial sources or may be provided using knowledge available to those of ordinary skill in the art.

Although preferred embodiments of the present invention have been described in detail herein, those skilled in the art will recognize that various substitutions and modifications may be made to the present invention without departing from the scope and spirit of the appended claims.

What is claimed is:

1. A method for installing a whipstock in a wellbore, said whipstock having a guide surface thereon for guiding devices inserted in said wellbore through a tubing string disposed in said wellbore, said method comprising the steps of:

inserting said whipstock in said wellbore and orienting said guide surface in a predetermined direction with respect to a longitudinal central axis of said wellbore;

encasing at least part of said whipstock in stabilizing material after orientation of said guide surface; and providing a pilot surface on said material for guiding a cutting tool for cutting through said material to engage said guide surface.

2. The method set forth in claim 1 wherein:

said stabilizing material is provided as cement.

3. The method set forth in claim 1 wherein:

the step of providing a pilot surface comprises cutting a generally cylindrical pilot bore in said material above said guide surface and generally centralized with respect to the central longitudinal axis of said wellbore.

4. The method set forth in claim 3 wherein:

the step of forming said pilot bore comprises inserting a tool into a said wellbore through said tubing string, said tool having cutting surfaces formed thereon for cutting an entry surface into said pilot bore and for cutting said pilot bore, respectively.

5. The method set forth in claim 1 including the step of:

moving said whipstock generally laterally with respect to the longitudinal axis of said well prior to encasing said whipstock so as to orient said guide surface for engagement by a tool.

6. The method set forth in claim 1 wherein:

said whipstock is inserted into said well through a tubing string in said well.

7. The method set forth in claim 1 wherein:

said whipstock is inserted into said well connected to a coilable tubing string.

8. A method for installing a whipstock in a wellbore, said whipstock having a guide surface thereon for guiding a device inserted in said wellbore through a tubing string disposed in said wellbore and pressure fluid operated actuator means for moving said whipstock laterally with respect to the longitudinal axis of said wellbore, said method comprising the steps of:

connecting said whipstock to a length of fluid conducting tubing;

inserting said whipstock with said tubing in said wellbore through a tubing string and out of a lower distal end of said tubing string; and moving said whipstock generally laterally with respect to the longitudinal axis of said well to orient said guide surface for engagement by said device by providing a pressure fluid signal through said tubing to operate said actuator means.

9. The method set forth in claim 8 including the step of:

encasing at least part of said whipstock in stabilizing material after orienting said guide surface.

10. A method for installing a whipstock in a wellbore, said whipstock having a guide surface thereon for guiding a device to be inserted in said wellbore through a tubing string disposed in said wellbore and actuator means for moving said whipstock laterally with respect to the longitudinal axis of said wellbore upon exiting the distal end of said tubing string, said method comprising the steps of:

providing inflatable packer means and inserting said inflatable packer means into said wellbore through said tubing string and placing said inflatable packer means in said wellbore at a predetermined position beyond the distal end of said tubing string, said inflatable packer means having means thereon for rotationally orienting said whipstock in a predetermined attitude with respect to the longitudinal axis of said wellbore;

connecting said whipstock to means for inserting said whipstock into and through said tubing string;

inserting said whipstock in said wellbore through said tubing string and out of said distal end of said tubing string and into engagement with said means on said inflatable packer to rotationally orient said whipstock with respect to said longitudinal axis; and effecting operation of said actuator means to move said whipstock generally laterally with respect to the longitudinal axis of said wellbore to position said guide surface for engagement by said device.

11. A whipstock for placement in a well to guide a device inserted in said well, said whipstock comprising:

means forming a guide surface on said whipstock for guiding said device when said device is inserted in said well;

means for connecting said whipstock to a fluid conducting tubing string extending within said well for conveying said whipstock to a predetermined position in said well; and actuator means for displacing at least a part of said whipstock including said guide surface from a first position which will permit insertion of said whipstock into said well to a second position for placing said guide surface in a predetermined position for guiding said device, said actuator means comprising a pressure fluid operated actuator responsive to receiving pressure fluid conducted through said tubing string at will for displacing said part into said predetermined position of said guide surface.

12. The whipstock set forth in claim 11 wherein:

said pressure fluid operated actuator includes a piston and cylinder and linkage means connected to said actuator for engagement with a wall surface of said well for moving said part generally laterally with respect to the longitudinal axis of said well into said predetermined position of said guide surface.

13. The whipstock set forth in claim 11 wherein:

said whipstock includes key means formed thereon and cooperable with key receiving means formed on a member disposed in said well for rotationally orienting said guide surface to be in a predetermined direction with respect to the longitudinal axis of said well.

14. The whipstock set forth in claim 11 wherein:

said whipstock includes a body member including said part and means on said body member for releasably connecting said whipstock to said tubing string, said body member including means forming a fluid conducting passage for conducting pressure fluid to said actuator means.

15. The whipstock set forth in claim 11 wherein:

said part comprises a body member including a fluid passage therein for conducting pressure fluid from said tubing string to said actuator means.

16. The whipstock set forth in claim 15 wherein:

said whipstock includes a stabbing member for engagement with a member disposed in said well for positioning said whipstock at a predetermined depth in said well, and said whipstock includes means interconnecting said stabbing member with said body member and operable to permit lateral movement of said body member relative to said stabbing member in response to operation of said actuator means.

17. The whipstock set forth in claim 16 including:

trunion means interconnecting said stabbing member and said body member and supporting said body member for pivotal and lateral movement of said body member relative to said stabbing member for placing said guide surface in said predetermined position.

* * * * *